US010024641B1

(12) United States Patent
Lauch

(10) Patent No.: US 10,024,641 B1
(45) Date of Patent: Jul. 17, 2018

(54) HAND GRENADE WITH AN EXPLOSIVE TRAIN INITIATION INDICATOR

(71) Applicant: The United States of America as Represented by the Secretary of the Army, Washington, DC (US)

(72) Inventor: Richard Lauch, Linden, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/615,010

(22) Filed: Jun. 6, 2017

Related U.S. Application Data

(60) Provisional application No. 62/348,297, filed on Jun. 10, 2016.

(51) Int. Cl.
*F42C 15/16* (2006.01)
*F42C 14/02* (2006.01)
*F42B 27/00* (2006.01)

(52) U.S. Cl.
CPC ..... *F42C 15/16* (2013.01); *F42B 27/00* (2013.01); *F42C 14/02* (2013.01)

(58) Field of Classification Search
CPC ..... F42C 14/00; F42C 14/02; F42C 15/16; F24B 27/00; F24B 27/08
See application file for complete search history.

(56) References Cited

U.S. PATENT DOCUMENTS

| | | | | |
|---|---|---|---|---|
| 2,203,640 A * | 6/1940 | Hines | F42C 14/02 102/261 |
| 2,421,762 A | 6/1947 | Short | |
| 2,562,928 A * | 8/1951 | Lewis | F42C 14/02 102/261 |
| 3,434,421 A | 3/1969 | Berlin et al. | |
| 4,925,752 A | 5/1990 | DiRubbio et al. | |
| 5,196,649 A | 3/1993 | DiRubbio et al. | |
| 8,561,540 B1 | 10/2013 | Lauch | |

FOREIGN PATENT DOCUMENTS

| | | | |
|---|---|---|---|
| DE | 1578492 A1 * | 3/1971 | F42C 14/02 |

* cited by examiner

*Primary Examiner* — Stephen Johnson
(74) *Attorney, Agent, or Firm* — John P. DiScala

(57) ABSTRACT

The subject invention provides a grenade which comprises a means of indicating, to a user, that the grenade's striker assembly has been activated, and thus provides an indication that the grenade has been initiated. Specifically, the subject invention provides such indication of striker activation, and thus grenade initiation, which is evident to the user by touch and feel, without the need for purposeful inspection of the grenade by said user. More specifically, the subject invention modifies the grenade's striker assembly to create a means to obstruct the safety lever from returning to its original position.

6 Claims, 6 Drawing Sheets

HAND GRENADE WITH AN EXPLOSIVE TRAIN INITIATION INDICATOR

CROSS-REFERENCE TO RELATED APPLICATIONS

This application claims the benefit under 35 USC § 119(e) of the U.S. provisional patent application 62/348,297 filed on Jun. 10, 2016.

STATEMENT OF GOVERNMENT INTEREST

The invention described herein may be made, used, or licensed by or for the United States Government, for Government purposes, without the payment of any royalties therefore.

FIELD OF THE INVENTION

This disclosure relates to hand grenades, generally. More particularly it relates to a safety feature, which provides an indication that a grenade has been armed, prompting disposal of said grenade, preventing the suffering of an explosive event due to inadvertent activation of a grenade striker mechanism.

BACKGROUND OF THE INVENTION

Hand grenades are small explosive, incendiary, or smoke producing devices thrown by military or law enforcement personnel in the course of military or law enforcement operations. Hand grenades typically have a body that contains an explosive or chemical filler and a fuze that ignites or detonates the filler in the grenade. The fuze contains a powder train that provides a time delay between the arming of the grenade and the actual detonation of the grenade. The fuze is lit by the action of a spring loaded striker mechanism impacting a primer which ignites a delay element that burns for a predetermined time and then detonates the filler. Typically, the grenade is prevented from being armed by a safety handle that blocks the striker mechanism from impacting the primer. A safety pin locks the safety handle to prevent the arming of the grenade. When the safety pin is withdrawn, the safety lever is free to release from the body of the grenade. When the safety lever is released, the striker spring unwinds and the striker rotates on axis to impact the primer, which then creates a flash of heat that ignites one end of the delay element. The delay element burns down to an igniter at the other end of delay element, which then sets off the main charge or filler of the grenade.

There exists a hazard, regarding grenades of this configuration, wherein, if a user relaxes his grip on the safety handle, after the safety pin has been removed, the striker may rotate and impact the primer, causing the fuze to light unbeknownst to the user. The lit fuze causes a chain reaction leading to detonation of the grenade. This may occur even though the safety handle has not been fully released, and also despite the user, perhaps, returning the safety handle to the initial, fully compressed, position. This is referred to as 'milking' a hand grenade, and has been the cause of numerous serious injuries and fatalities. Even though the problem has existed for decades, there have, heretofore been no solution to allow for detection of a milked grenade.

What makes this circumstance particularly dangerous is, where if a user may recompress their grip and the safety lever returns to the initial fully compressed position, there is a false sense of security that the grenade fuze is not initiated.

Existing designs exacerbate the situation because there is no means of determining either visually, tactilely, or audibly, that a grenade has been 'milked' as any indication of such is hidden under the safety lever. The quandary in such a situation is that the safety lever would have to be lifted to determine if the grenade had been milked, but lifting of the safety lever would ensure the activation of the grenade. Further, a user who 'milks' a grenade may likely do so in such a subtle or transient manner, or under such stressful or expedient circumstances, that it would not occur to the user that any milking may have occurred. Thus, there would not be cause to determine if 'milking' had occurred, even if a means for detection should exist. If a user had a quick and safe indication that 'milking' occurred, and the fuze had been initiated, he would likely have time to dispose of the grenade. This would prevent many serious injuries and fatalities. Further, it would be highly advantageous for such and indicator to be manifestly self-evident, and discernable to a user without the need for close, purposeful, inspection.

Prior art grenades address the issue of unintentional activation of a grenade via inadvertent removal of hand pressure offer solutions directed at decreasing the likelihood of the grenade being activated via said inadvertent hand pressure release, rather than providing any indication that such an activation has taken place: U.S. Pat. No. 2,203,640 issued to Hines, U.S. Pat. No. 4,926,752 to DiRubbio et al., and U.S. Pat. No. 5,196,649 also to DiRubbio et al. A grenade arming state indicator of U.S. Pat. No. 8,561,540 issued to Lauch involves providing a visual indication of the state of an arming thumb switch, which is essentially an additional safety, and does not provide any indication of whether the striker assembly has been activated nor does it provide an indication of whether the grenade has been initiated.

Thus a need exists in the art for a safety indicator mechanism to allow the grenade user to quickly and reliably discern striker activation and grenade initiation, without the need for purposeful inspection of the grenade by the user.

SUMMARY OF THE INVENTION

It is an object of the invention to provide a means of indicating the initiation state of a grenade, which initiation state is whether or not the primer has been activated, and thus whether the fuze has been initiated. A further object of the invention is to provide a indication of the initiation state of the grenade which is manifestly self-evident without the need for purposeful inspection of the grenade by the user.

To achieve these objectives, a means is provided, whereby if a grenade's safety mechanisms (in this case the safety lever and striker assembly) are disturbed from their initial safe position, sufficiently such that initiation occurs, then a safety mechanism (in this case the safety lever) is physically prevented from being returned to a state which is substantially similar to the initial safe position. Because the safety mechanism is physically held in a position which is sufficiently dissimilar from that of the initial safe position, its positioning commands the attention of the user as to the initiated state of the grenade. This is achieved by providing a feature on the striker assembly which obstructs the safety lever from returning to a position substantially similar to its initial safe position, and is rather held in a position which is dissimilar from the initial safe position. This additional feature may take the form of additional material on posterior side of the striker assembly, which, in the event the striker assembly has activated, obstructs the safety lever from returning to its original position.

An embodiment of the subject grenade invention is comprised of a grenade body, a fuze body which is inserted within and extends above the grenade body, a primer assembly disposed within the upper portion of the fuze body, a striker assembly which is pivotally connected to the fuze body and which is pivotally biased by means of a spring to bring its anterior side in impactive contact with the primer assembly, a safety lever which is removably attached to the fuze body and which, in its initial safe position, holds the striker assembly in its initial safe position which is a position pivoted away from contact with the primer assembly, and which safety lever, in its initial safe position, has a lower portion which is aligned substantially adjacent to the grenade body, a pin which is disposed to hold the safety lever in its initial safe position and which is removable, an indicator protrusion on the posterior side of the striker assembly, which indicator protrusion, when the striker assembly is pivoted into contact with the primer, obstructs the safety lever from returning to its initial safe position substantially adjacent to the grenade body.

DETAILED DESCRIPTION OF THE INVENTION

Figure 1:
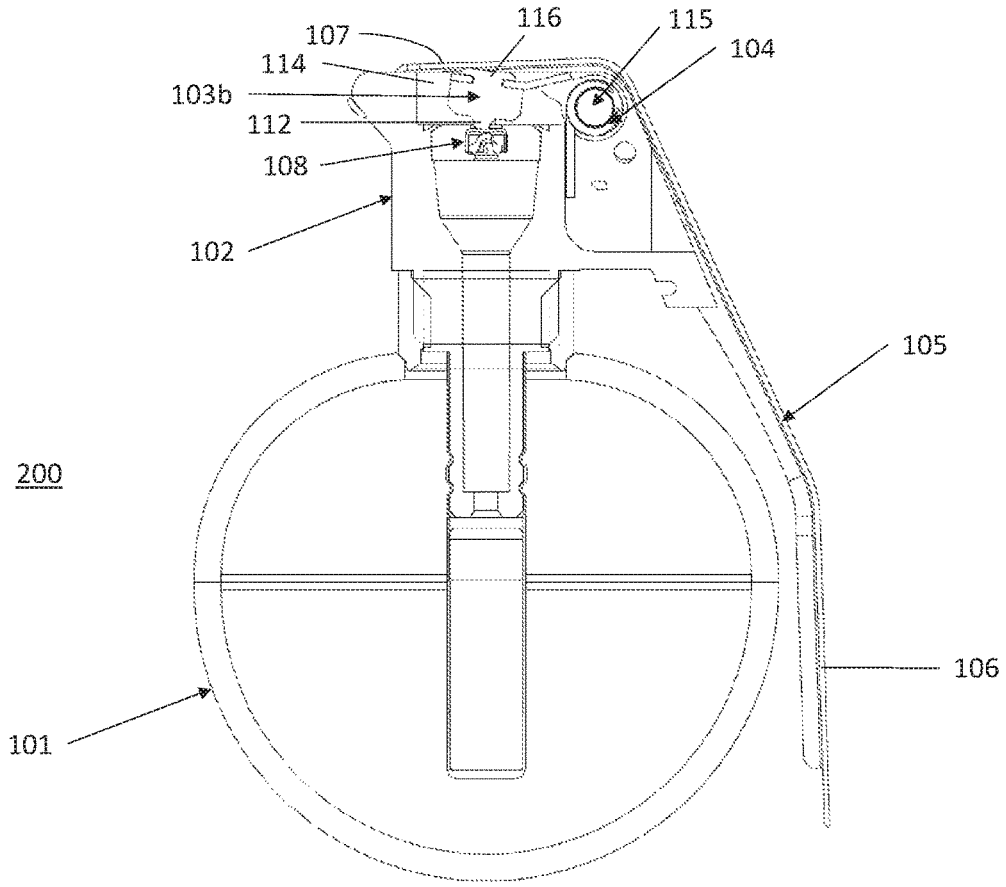
FIG. 1 PRIOR ART
FIG. 1 is a cutaway drawing of a prior art grenade, where the striker assembly has been activated, but where the safety lever is able to return to a position substantially similar to its original safe position.

In an embodiment of the subject invention, a grenade is provided, which is of a type comprising a grenade body, a fuze body, which is inserted in and extends from the upper extend of said grenade body, which fuze body contains a primer and fuze, and to which fuze body a striker assembly is pivotably connected, and which striker assembly is biased via a spring to a position in contact with the primer, and a safety lever, which is removably attached to said fuze body, and which safety lever has an initial safe position which is substantially adjacent to the grenade body.

The spring biased striker assembly is retained in an inactivated position, away from the primer, by the safety lever, and as the safety lever restrains the spring bias, the spring bias force urges outwardly said safety lever, urging said safety lever away from said grenade body. Wherein at a time during deployment of the grenade, a primary safety mechanism has been removed, such as the removal of a pin which would otherwise fix the safety lever in place, the user's grip is the only expedient to retain the safety lever in the initial safe position.

If the user's grip is relaxed by even a small amount, the spring bias of the striker assembly may force the safety lever sufficiently away from the grenade body that the striker assembly is allowed to pivot and strike the primer, initiating the grenade fuze. A user may not realize this, and may reassert their grip. This action is referred to as 'milking' the grenade.

According to the subject invention, a feature is provided on the posterior side of the striker assembly, which, if the striker assembly has been activated, and has pivoted into position whereby the anterior side of the striker assembly is in contact with the primer, said feature will obstruct the safety lever from being returned to the initial safe position, and will instead hold the safety lever at a position such that the safety lever is held away from the grenade body.

The required size of the feature may be tailored to the particular configuration of a given grenade design fitting this type. It is advantageous to the subject invention that the feature be of a sufficient size that it holds the safety lever at a sufficiently different position from the initial safe position that the position difference is immediately discernable, by feel, to a user, such that the user is given an indication of striker assembly activation and thus grenade initiation, without requiring close inspection by the user. In an embodiment of the subject invention, for instance in a grenade such as the M67 grenade, the feature is of a sufficient size that the lower portion of the safety lever, which is the portion generally held against the grenade body by the user, is obstructed from returning closer than 0.5 inches from the grenade body.

The overall dimension, that is the longitudinal thickness dimension, between the tip of the anterior striker and the end of the posterior indicator protrusion essentially determines an offset distance between said primer and the obstructing posterior indicator protrusion and this dimension may be sized depending on a given grenade design's particular configuration.

The feature may be made part of the striker assembly by various alternative methods without deviating from the scope of the subject invention. The best mode of achieving the required longitudinal thickness dimension in embodiments of the invention where the striker assembly include a striker point which is affixed to the striker lever by riveting, may be to design the rivet with sufficient material, so as after riveting, a posterior indicator protrusion of sufficient size remains. This is achievable using known riveting technology. Alternately, in a riveted striker assembly, where riveting leaves a 'rivet stem' extending in the posterior direction which would normally be trimmed off, a portion of this 'rivet stem' may be retained, providing sufficient additional material to achieve the required longitudinal thickness dimension. Still alternately, the striker assembly may be fabricated as a single striker component, and the additional material may be included as part of that striker.

Referring to the drawings in which like characters or references designate similar parts in various views, FIG. 1 depicts a prior art grenade 200 where the prior art striker assembly 103*b* is lacking a posterior indicator protrusion, and only has a rivet head 116 at the posterior of the striker assembly 103*b*. The striker assembly 103*b* of the prior art grenade 200 has also been allowed to rotate, by the bias of the spring 104 into the cavity 114 such that the anterior striker 112 of the striker assembly 103*b* has impacted the primer assembly 108. This impacting of the primer assembly 108 would, again, initiate the primer assembly, leading, after a predetermined delay, to grenade detonation.

However, the striker assembly 103*b* of the prior art grenade 200 is of a longitudinal thickness which is similar to the depth D of the cavity 114. Thus the safety lever 105 is allowed to return to a position substantially similar to its original safe position.

In a typical grenade, striker assembly rotation, and thus grenade activation, occurs when a user releases their compression on the safety lever, allowing the bias of the striker assembly to thrust the safety lever away from the grenade body, which in turn allows the striker assembly to fully rotate and strike the primer assembly. This may occur without the user's intent or knowledge, and the user may recompress the safety lever, without realizing that the striker assembly has rotated and that detonation of the grenade 200 is imminent. This action is referred to as 'milking' the grenade.

Figure 2:
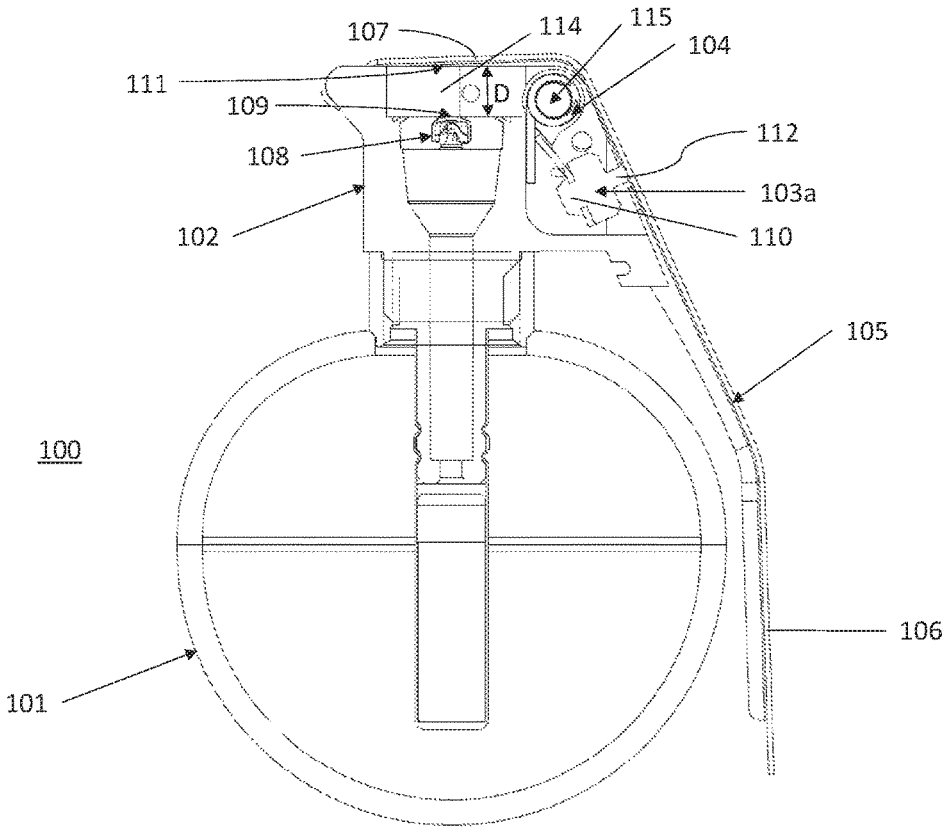
FIG. 2 is a cutaway drawing of a grenade according to an embodiment of the subject invention with all components in their initial safe position.

FIG. 2 depicts a grenade 100, according to an embodiment of the current invention, with all components in their safe and inactivated configuration. The fuze body 102 is attached to the top of the grenade body 101, and which fuze body 102 has a primer assembly 108 affixed within. The primer assembly 108 is affixed at the base of a cavity 114 in the top of the fuze body 102, such that the primer assembly's top surface 109 is at a depth D within the cavity 114 relative to the fuze body's upper extent 111.

A striker assembly 103*a* is pivotably connected, at the pivot 115, to the fuze body 102, and is pivotably biased by the spring 104, to rotate about the pivot 115, so as to impact the primer assembly 108. However in this depiction, the striker assembly 103*a* is being held in its inactivated position, against the bias of the spring 104, by the safety lever 105. The striker assembly comprises an anterior striker 112 and the posterior indicator protrusion [110]. The safety lever 105 has an upper portion 107 and a lower portion 106. The safety lever is depicted in its initial safe position, wherein the upper portion 107 is in contact with the fuze body's upper extent 111, and the lower portion 106 is substantially adjacent to the grenade body 101.

Figure 3:
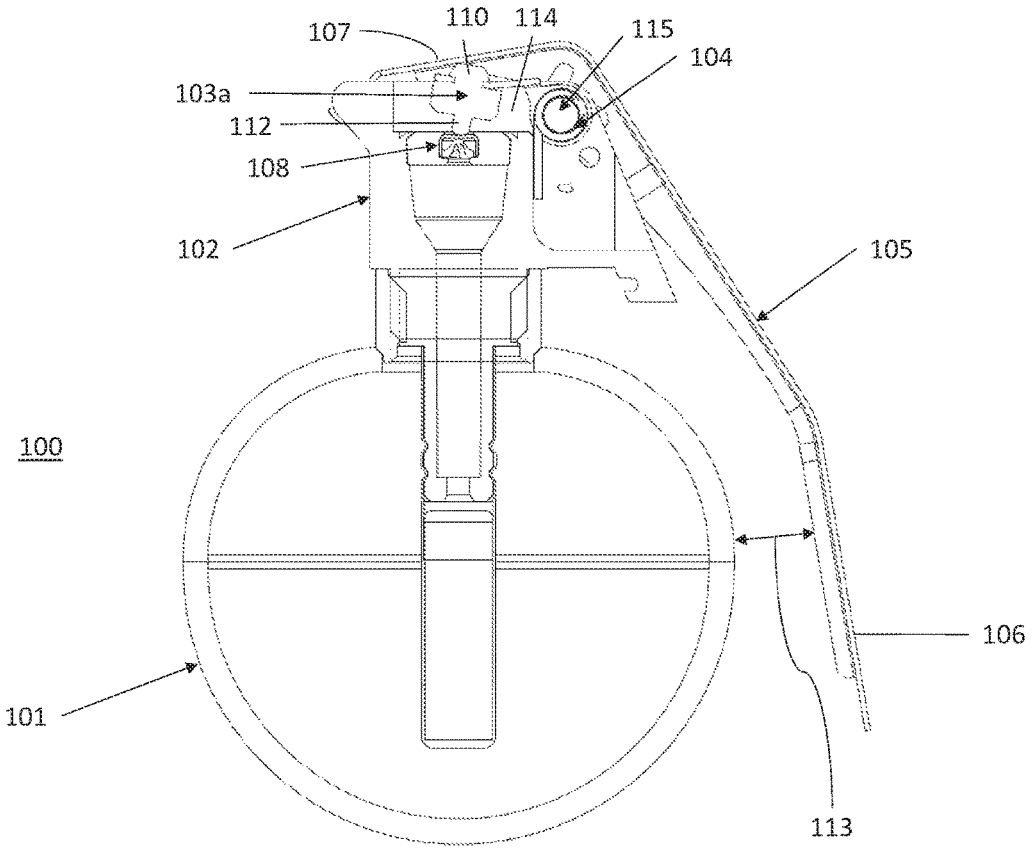
FIG. 3 is a cutaway drawing of a grenade according to an embodiment of the subject invention, where the striker assembly has been activated, but where the indicator protrusion is obstructing the safety lever and is holding the safety lever at a distance from the grenade body.

FIG. 3 depicts the grenade 100 of FIG. 2, wherein the striker assembly 103*a* has been allowed to rotate, by the bias of the spring 104 into the cavity 114 such that the anterior striker 112 of the striker assembly 103*a* has impacted the primer assembly 108. This impacting of the primer assembly 108 would initiate the primer assembly, which would, after a predetermined delay, ultimately lead to grenade detonation. In this embodiment, there exists a longitudinal thickness dimension 117 of the striker assembly 103*a*, which is described as extending between the tip of the anterior striker 112 and the posterior terminus of the posterior indicator protrusion 110.

As illustrated in FIG. 3, an important aspect of a grenade 100 embodying the subject invention, is that the longitudinal thickness dimension 117 of the striker assembly 103*a* is sufficiently greater than the depth D of the primer assembly 108 within the cavity 114, such that when the striker assembly 103*a* has rotated into the cavity 114, and the anterior striker 112 is resting on the primer assembly 108, the posterior indicator protrusion 110 extends sufficiently above the fuze body's upper extent 111 that it obstructs the upper portion 107 of the safety lever 105 from returning to its initial safe position in contact with the fuze body's upper extent 111. Further, the posterior indicator protrusion 110, is sized such that the longitudinal thickness dimension 117 of the striker assembly 103*a* is greater than the depth D of the cavity 114 to a degree that the upper portion 107 of the safety lever is angled away from the fuze body's upper extent 111, resulting in the entire safety lever 105 being angled away from the grenade body 101. The safety lever lower portion 106 is also levered away from the grenade body 101 to a sufficient dimension 113, which constitutes a second position of the lower portion 106 of the safety lever, different from the initial safe position, and which would be manifestly noticeable, particularly by feel, and without purposeful inspection, as the user holds the grenade in his hand. This is true even if attempts were made to reassert compression of the safety lever 105, and even if the safety lever lower portion 106 were to flex toward the grenade body 101 under the reasserted compression.

Figure 4:
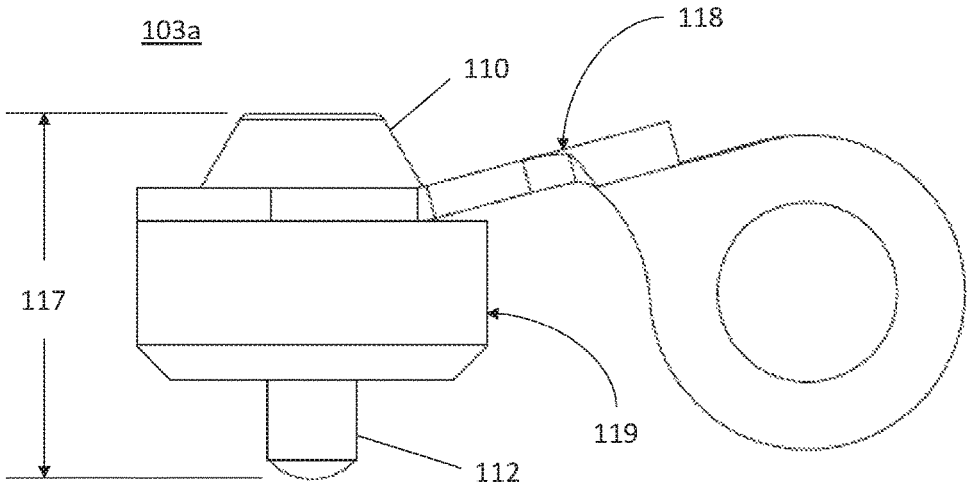
FIG. 4 is a drawing of a striker assembly according to an embodiment of the subject invention.
Figure 5:
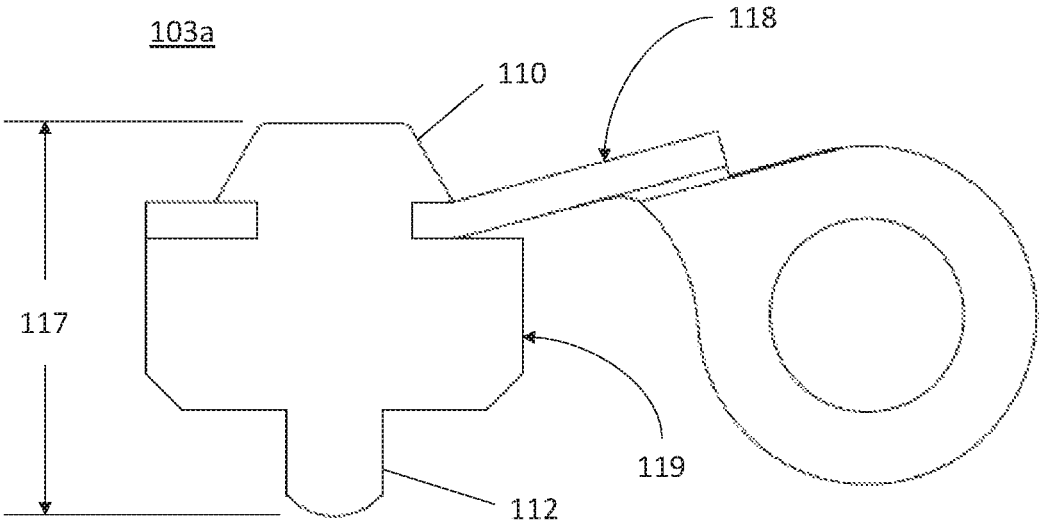
FIG. 5 is a cutaway drawing of a striker assembly according to an embodiment of the subject invention.
Figure 6:
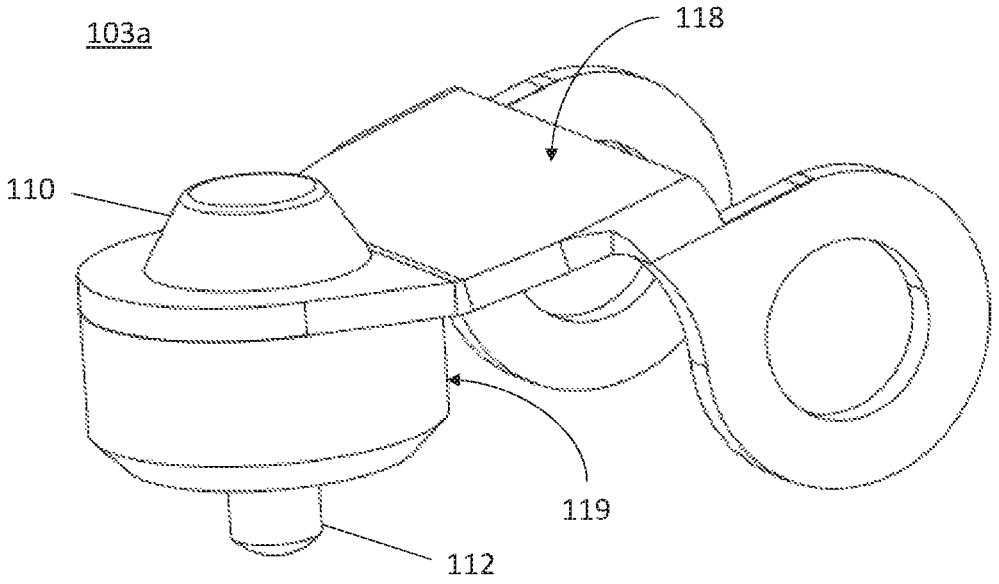
FIG. 6 is an isometric view drawing of a striker assembly according to an embodiment of the subject invention.

FIG. 4, FIG. 5 and FIG. 6 depict the striker assembly 103*a* according to an embodiment of the subject invention where the striker assembly 103*a* include a striker point 119 which is affixed to the striker lever 118 by riveting. The sizing of the posterior indicator protrusion 110 may be determined by a given grenade design, and designed to be sufficient to achieve the aforementioned manifestly noticeable indication. The longitudinal thickness dimension 117, which may be governed by the sizing of the posterior indicator protrusion 110, may be sized sufficiently greater than dimension D, such that the lower portion 106 of the safety lever 105 is held at a distance of no less than approximately 0.5 inches from the grenade body. This may be the case in an embodiment of the invention which is based on an M67 Grenade. Depending on the design of a given grenade, the size of the anterior striker 112 may also be increased to contribute to the overall longitudinal thickness dimension 117.

What is claimed is:

1. A hand grenade comprising a grenade body;

a fuze body fixed to a top of said grenade body;

a primer assembly fixed in said fuze body;

a safety lever having an upper portion and a lower portion, wherein said safety lever is removably attached to said fuze body, and wherein said lower portion is in an initial safe first position which is substantially adjacent to the grenade body when the grenade is in an inactive state; and a striker assembly comprised of a striker lever and a striker point, the striker point further comprising an anterior striker and a posterior protrusion and wherein said striker point is riveted to said striker lever, said striker assembly pivotably connected to said fuze body comprising an anterior side with the anterior striker and a posterior side with the posterior protrusion, wherein on activation of the striker assembly, the anterior striker contacts the primer assembly and the posterior protrusion extends beyond a top surface of the fuze body to contact the upper portion of the safety lever, thus preventing the upper portion of the safety lever from returning to a position flush with the fuze and thereby holding the lower portion of the safety lever in a second position.

2. The hand grenade according to claim 1, wherein said posterior protrusion is comprised of a retained rivet stem.

3. The hand grenade according to claim 1 wherein the striker assembly is a single component.

4. The hand grenade according to claim 1 wherein when the safety lever is in the second position, the lower portion of the safety lever is at a distance substantially away from the grenade body.

5. The hand grenade according to claim 4 wherein said distance is a minimum of 0.5 inches.

6. The hand grenade according to claim 5, wherein said grenade is a fragmenting grenade.

* * * * *